US009498077B2

(12) United States Patent
Carlson et al.

(10) Patent No.: US 9,498,077 B2
(45) Date of Patent: Nov. 22, 2016

(54) FOOTWEAR APPLICATION ASSISTING APPARATUS

(71) Applicant: 5 Star Innovations LLC, Brightwood, OR (US)

(72) Inventors: Jared Carlson, Brightwood, OR (US); Dallas Dockery, Welches, OR (US)

(73) Assignee: Five Star Innovations LLC, Brightwood, OR (US)

( * ) Notice: Subject to any disclaimer, the term of this patent is extended or adjusted under 35 U.S.C. 154(b) by 0 days.

(21) Appl. No.: 14/699,619

(22) Filed: Apr. 29, 2015

(65) Prior Publication Data

US 2015/0313396 A1 Nov. 5, 2015

Related U.S. Application Data

(60) Provisional application No. 61/987,644, filed on May 2, 2014.

(51) Int. Cl.
*A47G 25/90* (2006.01)

(52) U.S. Cl.
CPC ..... *A47G 25/905* (2013.01)

(58) Field of Classification Search
CPC .... A47G 25/905; A47G 25/80; A47G 25/82; A47G 25/90; A47G 25/908; A47G 25/907; Y10T 403/7045
USPC ..... 223/112, 118, 119
See application file for complete search history.

(56) References Cited

U.S. PATENT DOCUMENTS 4,620,737 A * 11/1986 Sanger ..... A47G 25/908 223/111
5,741,569 A * 4/1998 Votino ..... A47G 25/82 223/111
5,799,844 A 9/1998 James
6,056,171 A 5/2000 Santamaria
8,215,524 B1 * 7/2012 Swisher ..... A47G 25/82 223/111
2014/0263486 A1 * 9/2014 Taylor ..... A47G 25/905 223/111
2014/0263865 A1 * 9/2014 Salian ..... H02G 3/12 248/49

* cited by examiner

*Primary Examiner* — Anna Kinsaul
*Assistant Examiner* — Heather Mangine
(74) *Attorney, Agent, or Firm* — Hancock Hughey LLP

(57) ABSTRACT

The invention is defined by an elongate member having a handle end and an opposite sock-engaging end. The member is longitudinally flexible and may be shaped into a generally frusto-conically shaped tube onto which a sock is applied. The sock-engaging lower portion includes longitudinally outwardly projecting shoulders, and preferably sock engaging structures, that engage the sock to retain the sock in place during use. Immediately adjacent to and contiguous with the sock-engaging lower portion is a heel portion that is flexible transversely to the longitudinal axis along the device and which defines a heel-receiving area where the user's heel is placed when being used. Immediately adjacent to and contiguous with the heel portion is an elongate portion and an extended handle portion that the user grasps to pull the entire device upwardly to cause the sock to be properly placed on the user's foot. With the user's toe's inserted into the top of the sock, held open by the lower sock-engaging portion and the user's heel resting in the heel-receiving portion, the device is pulled upwardly by the user and the sock is pulled onto the user's foot in a normal manner. The shoulders on the device cause resistance to the force that tends to pull the sock off the device and the sock is thus pulled onto the user's foot in substantially the same way as the sock would be donned without the device—the sock is released from the shoulders as the resistive force is overcome by the upward pulling action.

13 Claims, 6 Drawing Sheets

FOOTWEAR APPLICATION ASSISTING APPARATUS

TECHNICAL FIELD

The present invention relates to devices designed to assist people with disabilities or limited range of motion, and more specifically, relates to an apparatus for use by people with disabilities or with limited mobility to put on socks and other footwear.

BACKGROUND

For most people, putting on a pair of socks is a daily task that it taken for granted and accomplished without difficulty of any kind. It is a simple task to bend over, whether seated or standing, and pull a sock over the foot.

But for people with disabilities or with conditions that temporarily or permanently cause limited mobility and range of motion, putting on a pair of socks can be either extraordinarily difficult, or impossible. As a result, such impaired people may either require assistance to put on socks, or not put on socks at all. Take, for example, a person with a back injury who is unable to bend over at the waist due to the injury. For a person having this disability, it can be near impossible to put a sock their foot in the usual way since bending over to put the opening of the sock over the toes requires bending at the waist and reaching downwardly with the arms to manipulate the sock into position. And even if a person with such a back injury can manipulate the sock over his or her foot, that is not the end of the process since the sock must then be pulled upwardly. This kind of pulling motion requires movement of both the arms and straightening of the back. While this movement is inconsequential to most people, again, for those with disabilities it can be very difficult.

Not surprisingly, given the need for apparatus that assist with donning a pair of socks, there are many known devices available. However, there is an ongoing need for devices that aid people who need assistance with putting on socks.

The present invention is a simple device that is easily manipulated by the disabled or elderly or others who need assistance with donning socks. The inventive device is defined by a sock-engaging lower portion that is defined by a longitudinally flexible member that is flexed into a generally frusto-conical shape and onto which a sock is applied. The sock-engaging lower portion includes longitudinally outwardly projecting shoulders that engage the sock to retain the sock in place during use. Immediately adjacent to and contiguous with the sock-engaging lower portion is a heel portion that is flexible transversely to the longitudinal axis along the device and which defines a heel-receiving area where the user's heel is placed when being used. Immediately adjacent to and contiguous with the heel portion is an extended handle portion that the user grasps to pull the entire device upwardly to cause the sock to be properly placed on the user's foot. With the user's toe's inserted into the top of the sock, held open by the lower sock-engaging portion and the user's heel resting in the heel-receiving portion, the device is pulled upwardly by the user and the sock is pulled onto the user's foot in a normal manner. The shoulders on the device cause resistance to the force that tends to pull the sock off the device and the sock is thus pulled onto the user's foot in substantially the same way as the sock would be donned without the device—the sock is released from the shoulders as the resistive force is overcome by the upward pulling action.

BRIEF DESCRIPTION OF THE DRAWINGS

The invention will be better understood and its numerous objects and advantages will be apparent by reference to the following detailed description of the invention when taken in conjunction with the following drawings.

FIG. 7 is a perspective view of the step of pulling a sock onto the sock assist apparatus.

FIG. 8 is a perspective view illustrating a next sequential step in a method of using the present invention, wherein the user is pulling the apparatus upwardly in order to pull the sock onto the user's foot.

DETAILED DESCRIPTION OF ILLUSTRATED EMBODIMENTS

Figure 1:
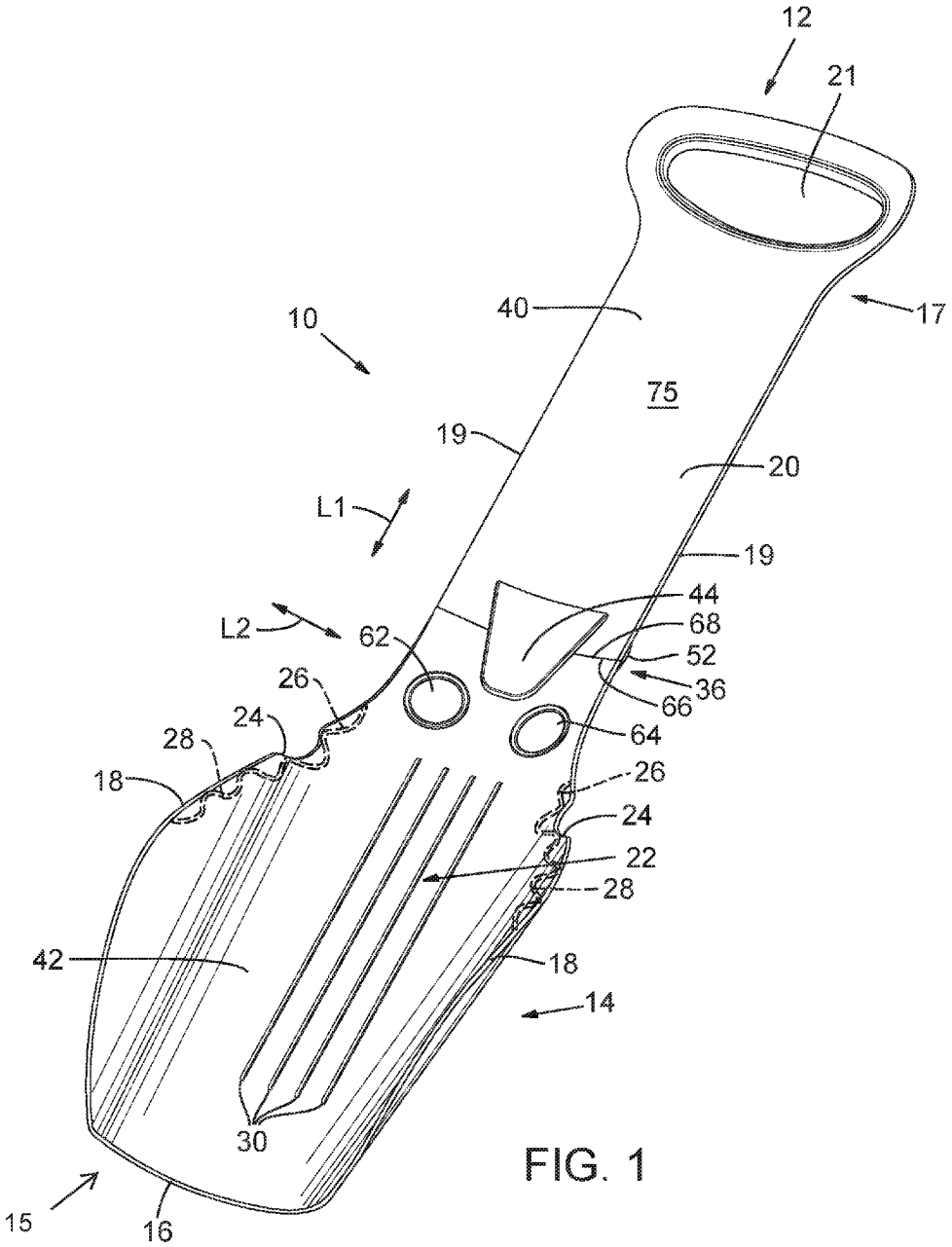
FIG. 1 is a perspective view of a first embodiment of a sock assist apparatus according to the present invention, showing the front side of the apparatus.

The invention and its method of use will now be described in detail with reference to the drawings. It will be understood that relative directional terms are used at times to describe components of the invention and relative positions of the parts. As a naming convention, the plane of the floor shown in the photographs is considered to be a generally horizontal surface. Other relative directional terms correspond to this convention: "upper" refers to the direction above and away from the floor plane; "lower" is generally in the opposite direction, "inward" is the direction from the exterior toward the interior of the apparatus, "vertical" is the direction normal to the horizontal floor plane, and so on. The "front" side of the sock assist apparatus is the side of the apparatus that faces a user's foot when the apparatus is being used; it is identified in the drawings with reference number 75. The "back" side is the opposite side of the apparatus and is identified with reference number 80.

Turning now to the drawings, a first embodiment of an apparatus 10 according to the present invention is illustrated both in its geometry and functionality. Apparatus 10 in FIG. 1 is shown in a generally relaxed position. As detailed below, the apparatus is fabricated from a flexible sheet material that can be flexed about at least two primary axes. The apparatus 10 is generally spoon shaped with a primary handle 12 at one end and a sock-engaging portion 14 at the opposite end. The longitudinal axis is shown in FIG. 1 with the line L1, which is parallel to the long axis extending from the handle 12 through the sock-engaging portion 14. The axis transverse to axis L1 is shown with line number L2.

Apparatus 10 is generally bilaterally symmetrical about longitudinal axis L1. For descriptive purposes, opposed shoulders 18 are defined tracing the from the lower, sock engaging end 15 beginning from the lower tip 16 of sock engaging portion 14, the edges of the apparatus 10 extend outwardly and upwardly toward the handle end 17, and in a normal condition the sides of the apparatus curve gently upwardly about the L1 axis toward the widest width of apparatus 10. Conversely, from the widest width of apparatus 10, the opposed shoulders taper inward toward the lower tip 16. The opposed shoulders 18 are further defined as the edges curve back toward L1 from the widest width and then transition to linear edges 19 at an elongate arm portion 20 that continues toward handle 12, which includes an opening 21 that defines a convenient hand-hold opening.

A heel-receiving area is defined in the area shown in FIG. 1 generally with reference number 22. The purpose of heel-receiving area 22 is described below.

As noted above, the sheet of material that is used to fabricate apparatus 10 is preferably flexible and a variety of types of plastic may be used. Some types of flexible plastic materials have a "memory" and will tend to retain a shape into which the material has been bent. As shown in FIG. 1, apparatus 10 has been folding about the axis L1 such that the shoulders 18 are raised upwardly relative to the centerline portion of the apparatus along L1, for example, the elongate portion 20 and handle 12. This is a desired and normal shape that apparatus 10 will tend to take on, although it is not required; in a normal relaxed position the apparatus may be relatively flattened. It will be appreciated that when the opposed shoulders 18 are folded inwardly toward one another as shown in FIG. 1, the portion of apparatus 10 from the shoulders 18 toward the lower tip 16 forms a truncated frusto-conical shape. This shape defines the sock-engaging portion of the apparatus.

Returning to FIG. 1, a sock engaging notch 24 is formed in the opposite edges of apparatus 10 adjacent shoulders 18. The portion of apparatus 10 adjacent shoulders 18 where the sock engaging notches 24 are located in FIG. 1 is the portion sock-engaging portion of apparatus 10 that engages a sock when the sock is installed on the apparatus preparatory to using the apparatus to put the sock on a user's foot. The notches 24 serve to engage the sock, which typically has some elastic qualities such as an elastic band, in order to provide a measure of resistance to pulling the sock off apparatus 10 once the sock has been pulled onto the apparatus over the notches, as detailed below. Other sock-engaging structures and techniques may be used either in place of or in lieu of the notches 24 in order to provide a sufficient engagement between apparatus 10 and a sock, yet allow the sock to be released from the apparatus when used. For example, a relatively higher friction material 26, shown in dashed lines in FIG. 1, may be applied to the apparatus 10 along the edges of the apparatus adjacent shoulders 18 where increased friction between a sock and apparatus 10 will aid in using the apparatus to don socks. For example, a high friction coating 28 such as a rubber-like material that is relatively soft compared to the plastic material of apparatus 10 may be applied at the edges of the apparatus extending upwardly along the edges toward and over shoulders 18. The high friction material may be applied as a coating, such as a rubberized coating or a rubber edge that is adhered to the edges of the apparatus, or a sandpaper-type of material. Still alternately, the edge material of the apparatus itself may be modified to increase the friction in the areas desired, such as by abrading the sheet material or by providing a serrated edge of the material itself. Plural notches such as notches 24 may similarly be used on both sides of the apparatus. The higher friction material such as high friction coating 28 has a greater coefficient of friction than the plastic (or other) material used to fabricate apparatus 10. Moreover, the sock-engaging portion defined by notches 24 are adjacent shoulders 18, the sock-engaging portion may extend over the shoulders in, for example, the instance where a high friction coating is utilized.

Figure 2:
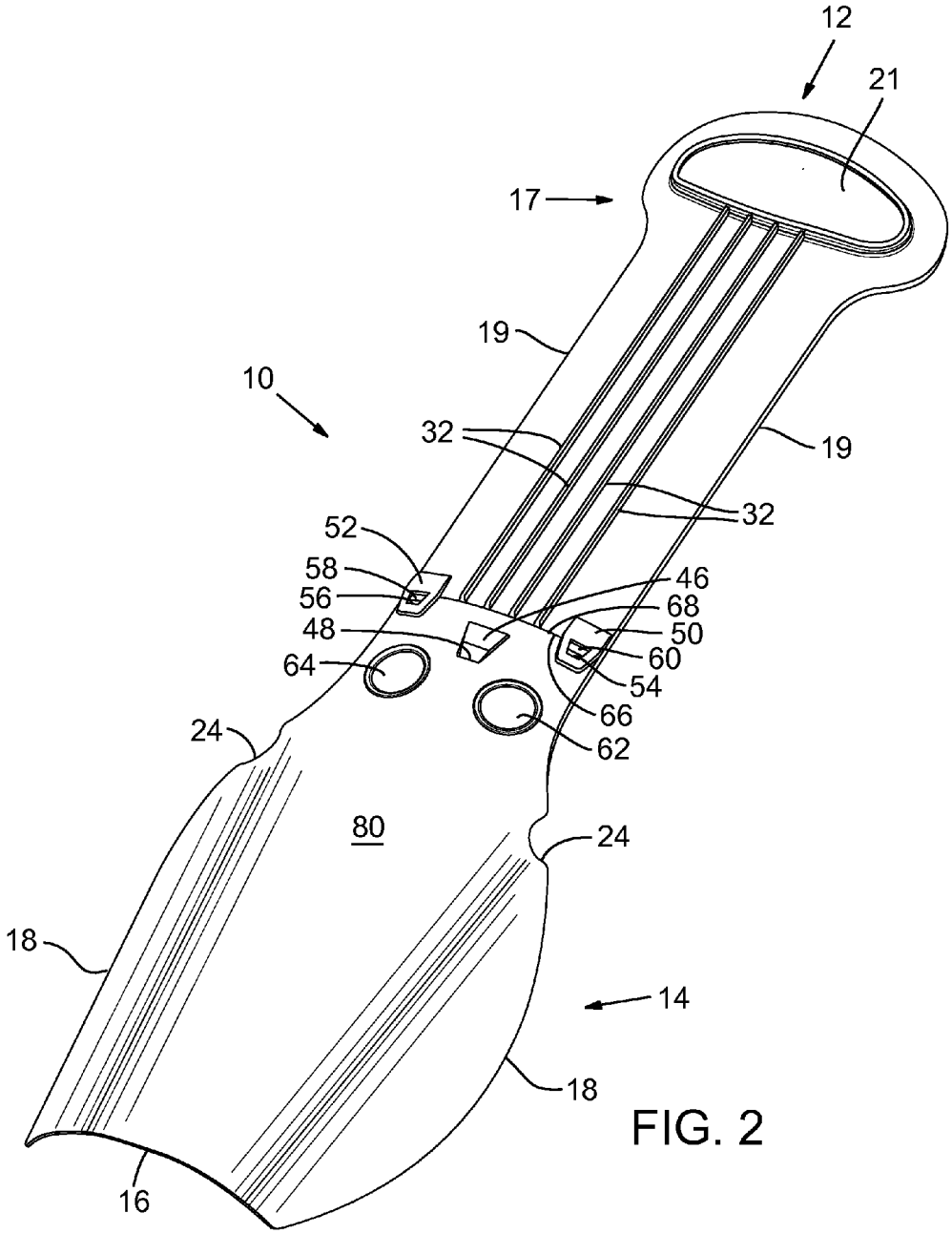
FIG. 2 is a perspective view of the apparatus shown in FIG. 1, illustrating the reverse side of the view shown in FIG. 1.

Plural ribs 30 or formed in the heel-receiving area 22 and extend longitudinally along the L1 axis. The ribs 30 serve a dual purpose. First, they tend to stiffen the apparatus 10 in order to resist somewhat folding of the apparatus about the L2 axis while at the same time permitting relatively easier folding along the L1 axis, and as detailed below, the ribs reduce friction between a user's foot and the apparatus 10 during use to ease the operation of the apparatus. With reference to FIG. 2, which shows the back side of apparatus 10, plural ribs 32 are formed and extend generally from the opening 21 of primary handle 12 toward the sock engaging portion 14 along the L1 axis. The ribs 32 provide a stiffening function, which could be accomplished with other structures as well, such as generally thicker materials.

In the preferred embodiment illustrated in FIGS. 1 through 4 the apparatus 10 is defined as a two-piece device comprising a handle piece 40 and a foot piece 42. The two pieces are detachable from one another using an attachment device referred to generally as attachment device 34. As best shown in views of FIGS. 3 and 4, handle piece are separate pieces that are attached together, and detachable from one another, at attachment device 34. Attachment device 34 is functional to securely interconnect the handle piece 40 and the foot piece 42 such that relative movement between the two pieces is eliminated when they are interconnected as in FIGS. 1 and 2. A central tab 44 is formed extending from the front surface 75 of handle piece 40 and a boss 46 is formed on the back side of central tab 44 (see, e.g., FIG. 4). A central notch 48 is formed in foot piece 42 and is located in a position to receive boss 46 when the handle piece 40 and foot piece 42 are interconnected. Secondary tabs 50 and 52 are formed on handle piece 40 on opposite sides of central tab 44 and extend from the back surface 80 of hand piece 40; each of the secondary tabs has a notch opening, referred to with reference numbers 54 and 56, respectively. Turning once again to FIG. 4, secondary bosses 58 and 60 are formed on the back side of foot piece 42 in positions on opposite sides of central notch 48 and are located in positions to receive secondary tabs 50 and 52, respectively, when the handle piece 40 and foot piece 42 are interconnected. Each of the bosses 46, 58 and 60 defines a sloped surface that rises from a reduced height leading edge to the an extended height of the boss at the trailing edge.

A pair of openings 62 and 64 are formed in foot piece 42. The purpose of these openings is detailed below.

Apparatus 10, including central tab 44 and secondary tabs 50, 52 are formed from resilient material, preferably plastic. As such, when handle piece 40 is attached to foot piece 42 with attachment device 34 the boss 46 of central tab 44 snaps into central notch 48 and secondary bosses 58 and 60 snap into the openings 54 and 56 of secondary tabs 50 and 52. Because the leading edges of the bosses are reduced in height relative to the trailing edges, the bosses slid into the tabs, which are deflected by the sloped bosses until the trailing edge of the bosses snap into the notches. The lower edge 66 of handle piece 40 is parallel to axis L2 and transverse to axis L1. Similarly, the upper edge 68 of foot piece 42 is parallel to axis L2 and transverse to axis L2. When handle piece 40 is attached to foot piece 42 the lower edge 66 of the handle piece faces and abuts the upper edge 68 of the foot piece as the tabs, bosses and notches of the attachment device 34 snap together as just described. As shown in the drawings, the central tab 44 extends from front surface 57 and the secondary tabs extend from the rear surface 80. When the handle piece and foot piece are connected, the combination of the central tab and secondary tabs essentially sandwich the two pieces together. This interconnection provides a very secure attachment between the handle and foot pieces and prevents relative movement between the pieces.

However, the handle piece 40 may be easily detached from the foot piece 42 by releasing the central tab 40 by pulling it upwardly from the foot piece 42 to disengage boss 46 from notch 48, then moving the handle piece relative to the foot piece to disengage the secondary bosses 58 and 60 from the secondary notches 54 and 56. Not only does disassembly of the handle piece from the foot piece allow for storage of apparatus 10 in a smaller overall size, but the foot piece 42 has separate utility as detailed below.

Figure 4:
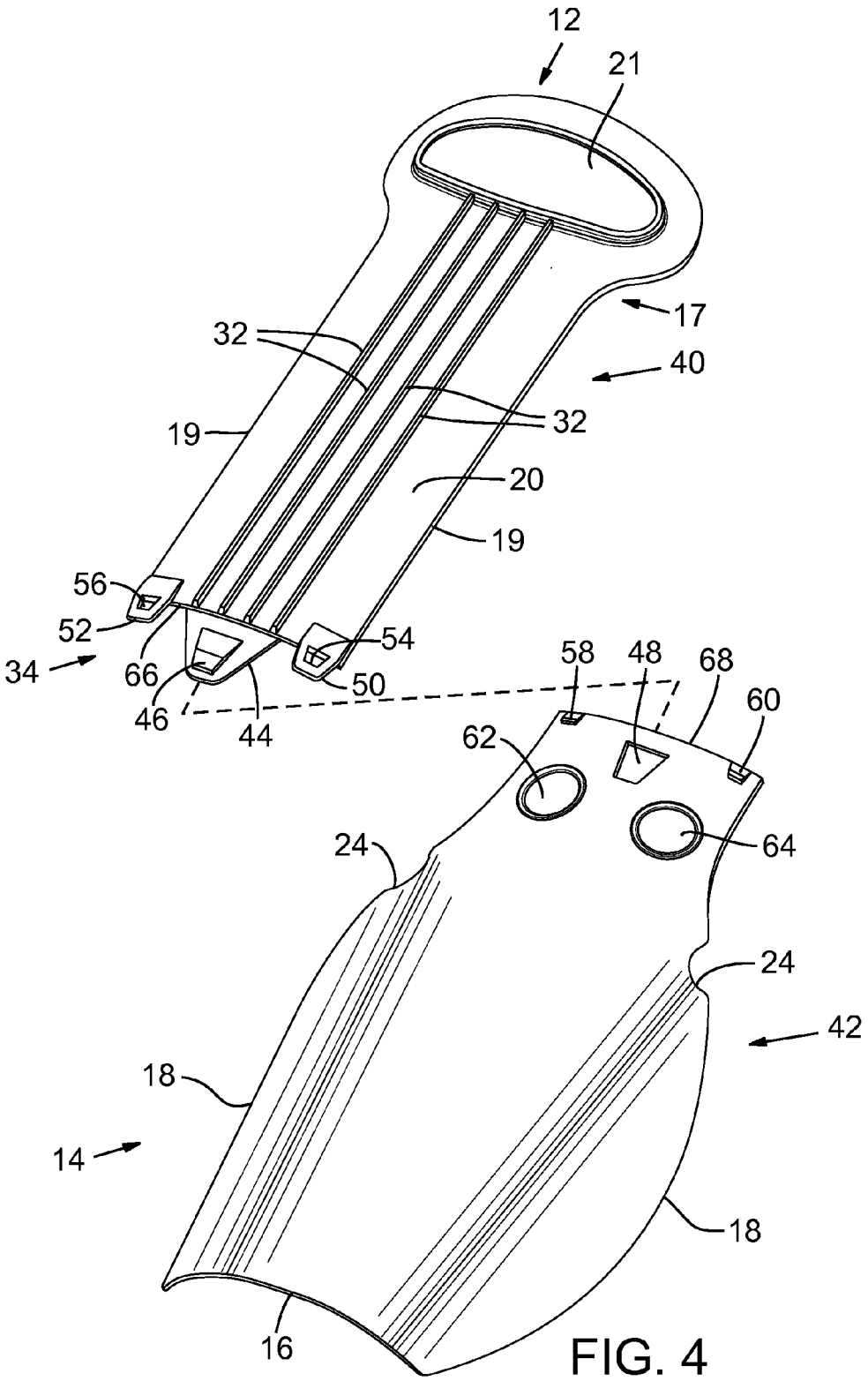
FIG. 4 is a perspective view of the disassembled apparatus shown in FIG. 3, illustrating the back side of the apparatus.
Figure 5:
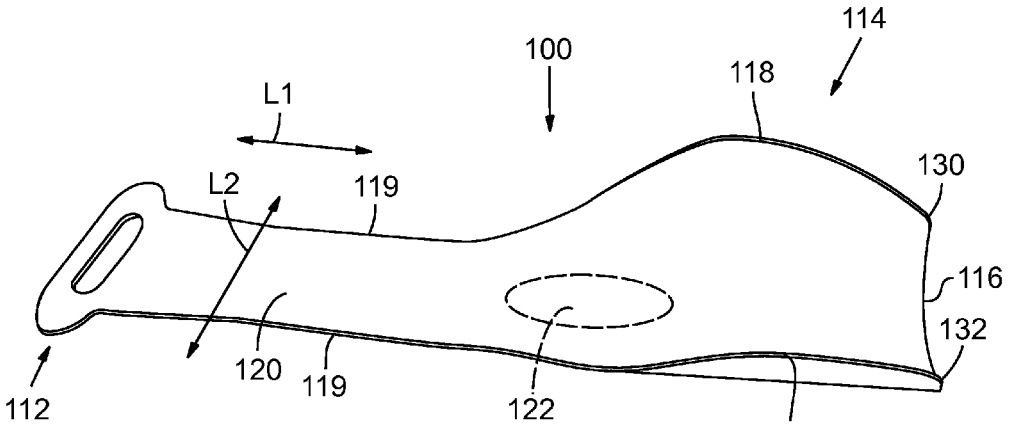
FIG. 5 is a perspective view of a second embodiment of the sock assist apparatus according to the present invention.
Figure 6:
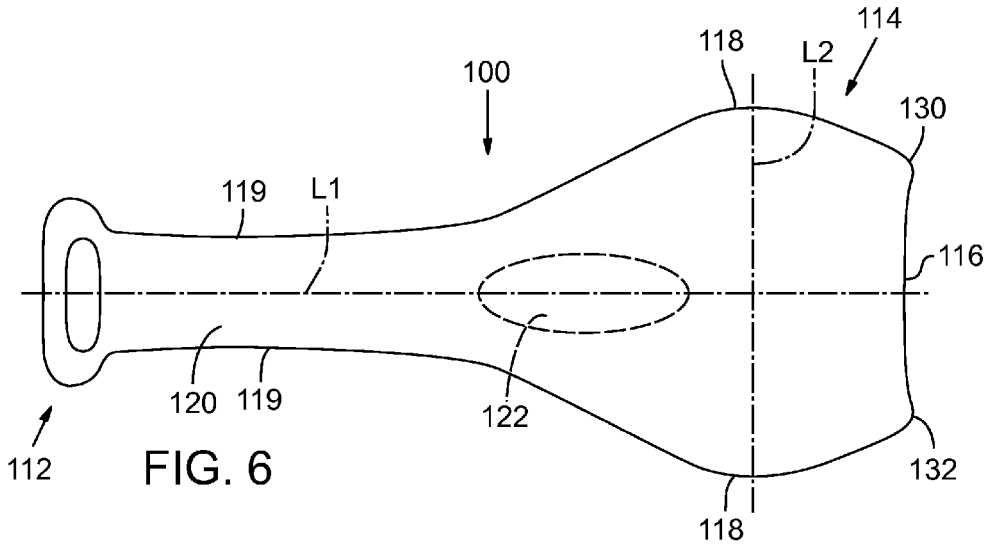
FIG. 6 is a top plan view of the apparatus shown in FIG. 5.

A second preferred embodiment of a sock assist apparatus 100 is shown in FIGS. 5 and 6. The sock assist apparatus 100 is functionally equivalent to sock assist apparatus 10 shown in FIGS. 1 through 4, but is fabricated in a single, unitary piece. With reference to FIG. 5, apparatus 100 is fabricated from a flexible sheet material that can be flexed about at least the two primary axes, L1 and L2. The single piece apparatus 100 is generally spoon shaped with a handle 112 at one end and a sock-engaging portion 114 at the opposite end. The longitudinal axis is shown in FIG. 1 with the line L1, which is parallel to the long axis extending from the handle 112 through the sock-engaging portion 114. The axis transverse to axis L1 is shown with line number L2.

Apparatus 100 is generally bilaterally symmetrical about longitudinal axis L1. Starting from the flattened edge 116 of sock-engaging portion 114, the edges of the apparatus 100 curve outwardly to the widest width at shoulders 118. From the shoulders 118, the edges curve back the central portion of apparatus 100 and then transition to linear edges 119 at an elongate arm portion 120 that continues toward handle 112.

A heel-receiving area is defined in the area shown in FIG. 5 with reference number 122. The purpose of heel-receiving area 122 is described below.

As noted above, the sheet of material that is used to fabricate apparatus 100 and also apparatus 10 is flexible and a variety of types of plastic may be used. Some types of flexible plastic materials have a "memory" and will tend to retain a shape into which the material has been bent. As shown in FIG. 5, apparatus 100 has been folding about the axis L1 such that the shoulders 118 are raised upwardly relative to the centerline portion of the apparatus along L1, for example, the elongate portion 120 and handle 112. This is a desired and normal shape that apparatus 100 will tend to take on, although it is not required. It will be appreciated that when the opposed shoulders 118 are folded inwardly toward one another, the portion of apparatus 100 from the shoulders 118 toward the flattened edge 116 forms a truncated frusto-conical shape. This shape defines the sock-engaging portion of the apparatus.

Figure 7:
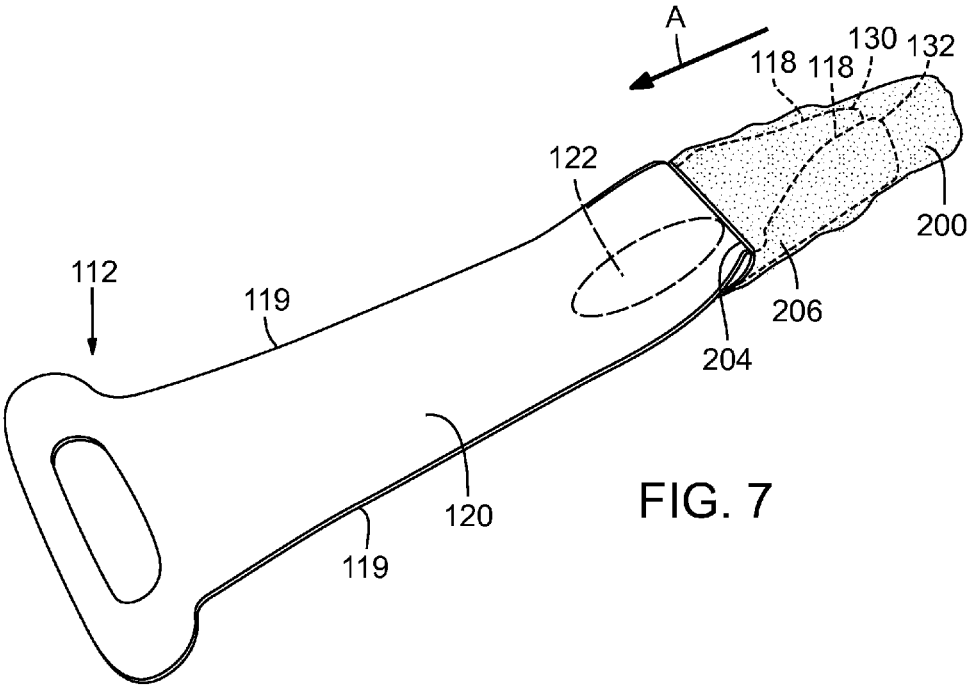
FIGS. 7 and 8 are a series of images that illustrate use of the sock assist apparatus according to the present invention, and in this case the embodiment shown in FIGS. 6 and 7, specifically.

Use of the sock assist apparatus according to the present invention as embodied by the embodiments of FIGS. 1 through 4 and FIGS. 5 and 6, and illustrated with the embodiment of FIGS. 5 and 6, is now detailed in respect of the embodiment of FIGS. 5 and 6—except in FIG. 7 there are notches similar to notches 24 illustrated to show how the sock is engaged. In FIG. 7, a sock 200 is in the process of being slipped onto apparatus 100. Specifically, the sock 200 is a typical sock that has a closed toe-end 202 and an opposite open end 204. Most socks have an elastic band or elastic area 206 that extends around the sock near the open end 204. Apparatus 100 is used by folding the shoulders 18 of apparatus 100 inwardly toward one another as shown in FIG. 7 until the outermost corners 130, 132 of flattened edge 116 approach one another and the shoulders 118 approach one another. This forms the truncated frusto-conical shape and the lower portion of apparatus 100 between shoulders 118 and flattened edge 116 essentially formed into a tube 134. The tube 134 thus formed is inserted into the open end 204 of sock 200 as shown in FIG. 7, and the sock is slid upwardly on the apparatus 100 in the direction shown with arrow A until the open end of the sock extends over the shoulders 118 and over the notches. If the sock is not long enough for the end of the sock to extend over the shoulders, the sock is slid entirely onto the apparatus until the closed toe-end 202 of the sock abuts flattened edge 116. In most cases, and except in the case of short socks, the elastic band area 206 will extend over the shoulders 118. With sock 200 positioned on apparatus 100 as shown in FIG. 7, the combination is ready to be employed by a person to don the sock.

It will be appreciated that the two-piece embodiment illustrated in FIGS. 1 through 4 is utilized in the identical manner. The sock 200 will be pulled onto the apparatus 10 until the elastic portion 206 of the sock is over the sock engaging notches 24 (or, a high friction material if it is used, or an abraded or serrated edge, if used and as detailed above). But in addition, as noted below, it is possible to use only the foot portion 42 of the embodiment of FIG. 1 to don a sock.

Figure 8:
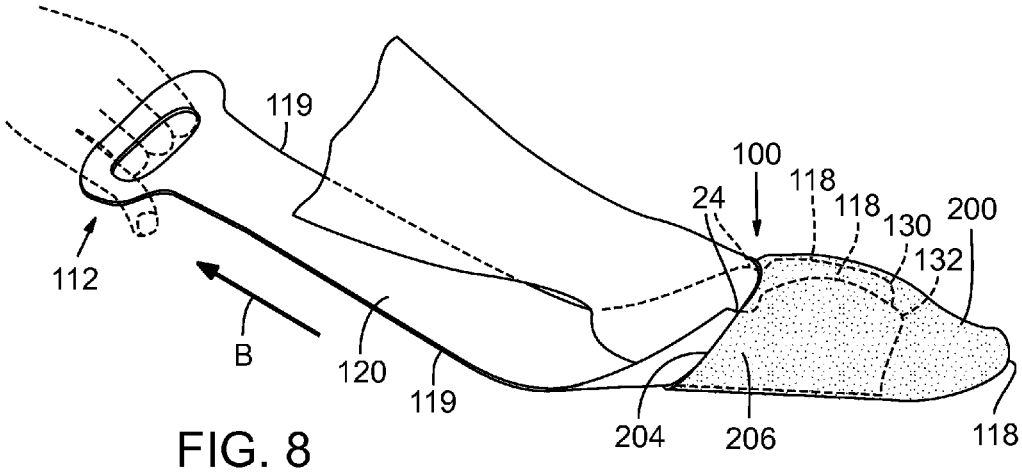

The apparatus 100 and also apparatus 10 are relatively easily flexed about the longitudinal axis L1 and also about the transverse axis L2. Since apparatus 10 of FIGS. 1 through 4 include stiffening ribs 22 and 32, it is relatively less flexible than the one-piece apparatus 100, but may nonetheless be flex in multiple dimensions. In FIG. 8, the "loaded" apparatus 100—that is, the apparatus 100 with a sock 200 installed on it—is ready to be used to apply the sock 200 to a user's foot. Since the apparatus of the present invention is flexible the apparatus may be twisted about both axes and formed into other shapes during use, including torsional rotation. In addition, since apparatus is formed of a flexible and resilient material, the open end 204 of sock 200 will be held open by the resiliency of the lower sock-engaging portion 114, for example, as the shoulders 118 are urged by the resiliency of the material toward the normal resting position shown in FIG. 5.

Use of apparatus 100 and also apparatus 10 by a user to apply a sock to his or her foot is illustrated in FIG. 8. With the sock 200 applied onto apparatus 100 as shown in FIG. 8, a user inserts his or her toes into the open end 204 of sock 200, which is being held open by the resilient properties of apparatus 100. Thus, the user's foot is inserted into the tube 134 until the user's heel rests in the heel-receiving area 122 that is generally between shoulders 118. The user then grasps handle 12 and pulls the handle and thus the entire apparatus 100 upwardly as shown with arrow B in FIG. 8. As this is done, the apparatus 100 tends to flex along the elongate portion 120 about the L2 axis and the elongate portion 120 tends to conform to the contours of the user's leg as the apparatus is pulled upwardly. As the apparatus slides upwardly over the user's foot, the sock 30 is pulled onto the foot. The shoulders 18 (and the sock-engaging notches 24 of the embodiment of FIG. 1) apply resistance force against the interior of the sock as the handle is pulled upwardly, and therefore the sock is pulled upwardly with the shoulders 18 as the apparatus 100 moves upwardly and over the user's heel. Eventually, when the user's toes are abutting the closed end 202 of sock 200, the resistive force of the shoulders is overcome and the elastic band area 206 of the sock 200 slides over the shoulders 118 and as the apparatus 100 is pulled out of the sock, the sock is applied correctly to the user's foot.

Apparatus 10 may similarly be used to apply a slipper or shoe to a user's foot in the same way described above for a sock, in the manner of a shoe horn. The apparatus is functional to apply any type of stocking, including therapeutic garments and compression socks.

With returning reference to the embodiment of FIGS. 1 through 4, the elongate stiffening ribs 30 serve to reduce the friction between apparatus 10 and a user's foot when apparatus 10 is being used, and thus ease application of a sock 200 onto the user's foot. More specifically, a user's foot is often damp with sweat and the moisture increases the friction between the foot and the apparatus 10. The stiffening ribs 30 decrease the area of contact between the user's foot and the apparatus 10 in the heel-receiving area 22 and thereby decrease the amount of force required to pull apparatus 10 out of a sock 200 as described above.

Figure 3:
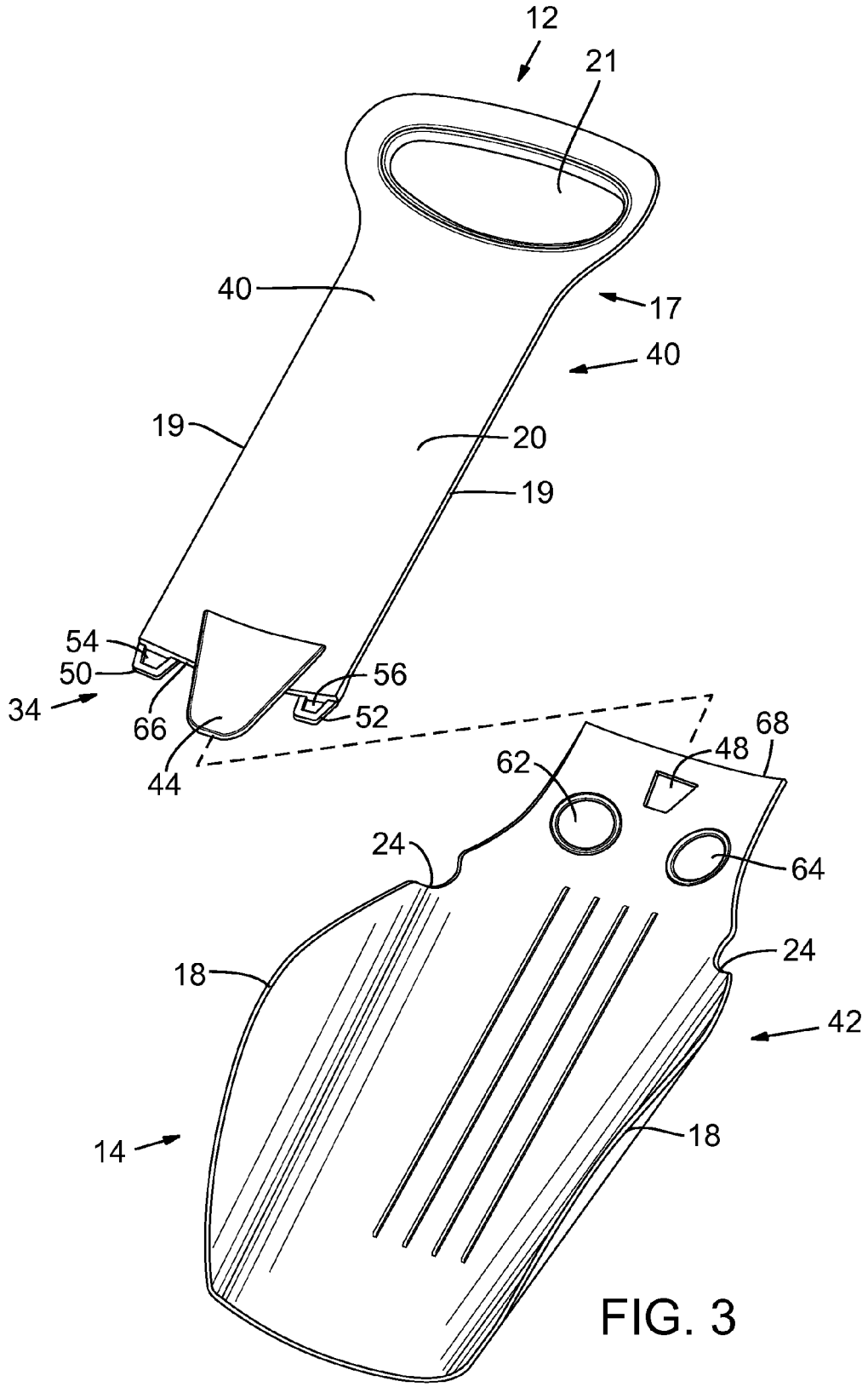
FIG. 3 is a perspective view of the sock assist apparatus shown in FIG. 1 showing the two pieces of the apparatus in a disassembled condition.

Both the handle piece 40 and the foot piece 42 have separate utility when they are detached from one another as shown in FIGS. 3 and 4. For instance, handle piece 42 may be used to remove a sock, including and especially a compression sock, from a user's foot. In this regard, a user slides the handle piece down the back side of the user's calf portion of the leg until the central tab 44 is inserted between the sock and the back of the leg. The user continues to slide the handle piece downwardly toward their heel. The upper edge of the sock is held by the tab 44 and the sock is thus pushed over the user's heel until it is easily removed.

The two openings 62 and 64 in foot piece 42 define finger holds, that is, a handle, which may be used when the foot piece 42 is used when the handle piece 40 is detached from the foot piece 42. Thus, the foot piece 42 may be used without handle piece 40 for all of the same purposes as the combined handle and foot pieces described above. One opening 62 may be used in lieu of the dual openings shown in the figures.

Those of skill in the art will recognize that certain modifications of the structures described above may be made without changing the nature or scope of the invention. As an example, the basic shape of the handle 12, shoulders 18 and the elongate arm portion 20 may be varied from the shapes shown in the drawings. And of course, the size of apparatus 10 and 100 may be varied as necessary. Other similar modifications will be recognized as well.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. Apparatus for assisting a user to don a sock, comprising:

a flexible, resilient and two-piece elongate body member having handle end and an opposite sock-engaging end with a longitudinal axis extending from the handle end to the sock-engaging end;

said sock-engaging end defining a distal end with a flattened edge and opposed shoulders extending away from the longitudinal axis and said opposed shoulders extending inwardly to said distal end;

wherein, said sock-engaging end is formable into a truncated frusto-conical tubular member when said elongate body member is folded about said longitudinal axis so that said shoulders are folded toward one another and such that a sock may be applied over said frusto-conical member;

wherein the elongate body member is defined by a handle portion that is selectively detachable from a foot portion at a detachment device, and wherein the detachment device is defined by a central tab with a boss on a first side of one of the handle portion or the foot portion, and a central notch formed on the opposite of the handle portion or the foot portion and positioned to receive the boss; and a pair of secondary tabs on a second side of one of the handle portion or the foot portion, one of said pair located on each side of said central tab and each of said pair defining a secondary notch, and a pair of secondary bosses on the opposite of the handle or foot portion, wherein the secondary notches are positioned to receive the secondary bosses.

2. The apparatus according to claim 1 wherein said sock-engaging end further defines a notch adjacent each of said opposed shoulders.

3. The apparatus according to claim 1 wherein said sock-engaging end further defines sock engaging means adjacent each of said shoulders.

4. The apparatus according to claim 3 wherein the sock-engaging means is defined by an edge portion of said elongate body portion that has a higher coefficient of friction than a coefficient of friction of the elongate body portion.

5. The apparatus according to claim 4 in which the edge portion includes a notch.

6. The apparatus according to claim 4 in which the edge portion comprises a high friction coating material.

7. The apparatus according to claim 1 wherein the foot portion includes at least one bore therethrough to define a handle.

8. The apparatus according to claim 1 wherein said foot portion comprises plural elongate ribs extending along the longitudinal axis.

9. The apparatus according to claim 8 wherein the handle portion comprises plural elongate ribs extending along the longitudinal axis.

10. The apparatus according to claim 9 wherein said elongate body member is flexible about an axis transverse to the longitudinal axis.

11. Apparatus for assisting a user to don a sock, comprising:

an elongate and two piece body member having a handle end and an opposite sock-engaging end, the sock-engaging end defining a terminal end and said elongate body member defining a longitudinal axis extending from the handle end to the terminal end of the sock-engaging end and wherein the first piece of the two piece body member comprises a handle portion, the second piece of the two piece body member comprises a foot portion, and wherein the handle portion is selectively detachable from the foot portion at a detachment device defined by a central tab with a boss on a first side of one of the handle end or the sock-engaging end, and a central notch formed on the opposite of the handle end or the sock-engaging and positioned to receive the boss; and a pair of secondary tabs on a second side of one of the handle portion or the sock-engaging end, one of said pair located on each side of said central tab and each of said pair defining a secondary notch, and a pair of secondary bosses on the opposite of the handle or sock-engaging end, wherein the secondary notches are positioned to receive the secondary bosses;

and wherein said sock-engaging end defines opposed edges on opposite sides of said longitudinal axis wherein each of said opposed edges defines a shoulder and said sock-engaging end is at a widest point along an axis transverse to said longitudinal axis between said shoulders and said shoulders taper inward toward said terminal end, and including sock engaging means for engaging a sock with said body member;

wherein said sock-engaging end is formable into a truncated frusto-conical tubular member when said elongate body member is folded about said longitudinal axis so that said opposed edges are folded toward one another and such that a sock may be applied over said frusto-conical member.

12. Apparatus according to claim 11 wherein said sock engaging means is defined by a notch formed in each of the respective side edges that are adjacent said shoulders.

13. Apparatus according to claim 12 wherein said sock engaging means is defined by a high friction treatment on each of said opposed side edges.

* * * * *